US007878591B2

(12) United States Patent
Walker et al.

(10) Patent No.: US 7,878,591 B2
(45) Date of Patent: Feb. 1, 2011

(54) SACRAL SUPPORT MEMBER FOR SEATING

(75) Inventors: Brock M. Walker, Okemos, MI (US); Andrew J. Kurrasch, Saugatuck, MI (US); Ted R. Martin, Hudsonville, MI (US)

(73) Assignee: Herman Miller Inc., Zeeland, MI (US)

( * ) Notice: Subject to any disclaimer, the term of this patent is extended or adjusted under 35 U.S.C. 154(b) by 0 days.

(21) Appl. No.: 10/900,551

(22) Filed: Jul. 27, 2004

(65) Prior Publication Data

US 2005/0104428 A1 May 19, 2005

Related U.S. Application Data

(63) Continuation of application No. PCT/US03/02251, filed on Jan. 27, 2003.

(60) Provisional application No. 60/352,656, filed on Jan. 28, 2002, provisional application No. 60/387,654, filed on Jun. 10, 2002.

(51) Int. Cl.
*A47C 7/46* (2006.01)

(52) U.S. Cl. ..... 297/284.4

(58) Field of Classification Search ..... 297/284.4, 297/284.7, 440.11
See application file for complete search history.

(56) References Cited

U.S. PATENT DOCUMENTS

| | | | | |
|---|---|---|---|---|
| 4,502,728 | A | 3/1985 | Sheldon et al. | |
| 4,541,670 | A | 9/1985 | Morgenstern et al. | |
| 4,883,320 | A * | 11/1989 | Izumida et al. | 297/452.56 |
| 4,981,325 | A | 1/1991 | Zacharkow | |
| 5,101,811 | A | 4/1992 | Brunswick | |
| 5,507,559 | A * | 4/1996 | Lance | 297/284.5 |
| 5,577,811 | A | 11/1996 | Ogg | |
| 5,590,427 | A | 1/1997 | Weterings et al. | |
| 5,887,951 | A | 3/1999 | Willingham | |
| 5,967,608 | A | 10/1999 | Van Sickle | |
| 6,079,785 | A | 6/2000 | Peterson et al. | |

(Continued)

FOREIGN PATENT DOCUMENTS

| | | |
|---|---|---|
| EP | 0 130 169 A1 | 8/1984 |

(Continued)

OTHER PUBLICATIONS

ISA/US, International Search Report for parent International Patent Application No. PCT/US03/02251 mailed Jul. 7, 2003.

(Continued)

*Primary Examiner*—Peter R. Brown
(74) *Attorney, Agent, or Firm*—Leydig, Voit & Mayer, Ltd.

(57) ABSTRACT

A chair for providing sacral support including a seat, a backrest, a flexible support member and a sacral support member. The backrest has a frame with a generally central opening. The membrane is formed from an elastic material connected to the frame and extends across the central opening. A sacral support member is positioned proximate the central opening and is configured to apply support to the sacrum of a user sitting on the seat. The sacral support member incorporates a load distribution system and method in order to properly support and fit the anatomical contours of the sacrum and pelvis of a user while seated in the chair.

9 Claims, 8 Drawing Sheets

U.S. PATENT DOCUMENTS

| | | | | |
|---|---|---|---|---|
| 6,125,521 | A | 10/2000 | Stumpf et al. | |
| 6,125,851 | A | 10/2000 | Walker et al. | |
| 6,354,662 | B1 * | 3/2002 | Su | 297/284.7 |
| 6,471,294 | B1 * | 10/2002 | Dammermann et al. | 297/284.7 |
| 6,572,190 | B2 * | 6/2003 | Koepke et al. | 297/284.1 |
| 6,913,315 | B2 * | 7/2005 | Ball et al. | 297/284.7 |

FOREIGN PATENT DOCUMENTS

| | | | |
|---|---|---|---|
| EP | 0 130 169 | | 1/1985 |
| EP | 0 419 714 | A1 | 9/1989 |
| EP | 0 904 761 | A1 | 3/1999 |
| GB | 2 231 257 | A | 11/1990 |
| GB | 2 235 369 | A | 6/1991 |
| GB | 2 178 652 | A | 2/1997 |
| WO | WO 84/04873 | | 12/1984 |

OTHER PUBLICATIONS

Patent Office, The, Examination Report related to cognate British Application No. GB0415854.9 mailed Oct. 27, 2004.

Canadian Intellectual Property Office, Examiner's Requisition related to cognate Canadian Application No. 2,473,978 mailed Nov. 8, 2007.

Mexican Institute of Industrial Property, Office Action related to cognate Mexican Application No. PA/a/2004/007241 mailed Jan. 22, 2010, translated by Becerril, Coca & Becerril, S.C. Feb. 17, 2010.

* cited by examiner

SACRAL SUPPORT MEMBER FOR SEATING

RELATED APPLICATIONS

This application is a continuation under 35 U.S.C. §120 of PCT Application No. PCT/US03/02251. This application also claims priority to U.S. Provisional Application Ser. No. 60/352,656, filed Jan. 28, 2002 and U.S. Provisional Application Ser. No. 60/387,654, filed Jun. 10, 2002.

FIELD OF THE INVENTION

The present invention relates generally to a sacral support member for seating. More particularly, this invention relates to a sacral support member that incorporates a load distribution method and system in order to properly support and fit the anatomical contours of the body of a user while seated in the chair.

BACKGROUND OF THE INVENTION

The spine is broken down into four general regions: cervical (neck), thoracic (upper back), lumbar (lower back) and sacral (tail bone). In a natural aligned spine, the thoracic spine has a kyphotic, or gentle convex curve when viewed from the side. A lordotic lumbar spine, when viewed from the side, has a slightly concave curve. The sacrum is the base of the spine. It is a large triangular fusion of five vertebrae wedged between the pelvic bones. The connection of these bones is called the sacroiliac joint. Back problems can occur where the lumbar spine connects to the sacrum.

Sitting up straight can be difficult for the users of many chairs. In particular, in many seating devices a void exists between the backrest of the chair and the sacrum of a user. As a result, the user of the chair may take a slouched position. By slouching, the user will be placed in a position of poor posture, lack of muscle control and discomfort. Slouching can lead to a number of immediate problems. For example, increased fatigue or fidgeting may result because of discomfort. In addition, undesirable physical effects such as increased pressure on the lumbar discs or the creation of muscle spasms may also result from slouching. Various long-term problems may also occur. For example, pain in the lower back muscles or discomfort between the shoulder blades may result. Also, the tightening of neck muscles and muscle soreness and headaches may result.

In order to avoid problems associated with slouching, previous attempts have been made to provide better support for the sacrum. However, these attempts have generally failed to provide a specific sacral support and contoured fit that will properly position the sacrum, the pelvis, and the supporting neural, muscular, and skeletal systems to provide total pelvic stability. In the past, the void that existed between the sacrum and the back of a work chair failed to provide the preferred support for the sacrum and adjoining tissue.

Somewhat recently, it has been recognized that a spinal support device for applying a directed and concentrated force on the sacrum to properly position the pelvis and spine of a user could be constructed. In U.S. Pat. No. 6,125,851 (Walker), a spinal support device is disclosed that helps support the sacrum of a user to allow the spine to take the preferable shape found in a normal standing posture. While addressing the support of the sacrum, there exists a need to implement proper sacral support in an ergonomic work chair that otherwise properly and comfortably positions a worker for performing tasks.

SUMMARY OF THE INVENTION

The present invention is directed to an improved ergonomic chair having a sacral support member. The sacral support member stabilizes the sacrum and prevents posterior rotation of the pelvis, thereby promoting a lordotic lumbar spine and allows the chest and shoulders of a user to come posterior, i.e., achieve an improved posture. As a result, the body of a user will be able to sit straight up for longer periods of time, thereby generally reducing muscle fatigue, and improving body strength, endurance, and comfort.

According to a first aspect of the present invention, a chair having sacral support is provided. The chair includes a seat, a backrest, a membrane and a sacral support member. The backrest has a frame with a generally central opening. The membrane is formed from an elastic material connected to the frame and extends across the central opening. A sacral support member is positioned proximate the central opening and is configured to provide an improved load distribution method and system and applies proper support to the sacrum of a user sitting on the seat.

According to another aspect of the invention, a chair having sacral support is provided. The chair includes a seat, a backrest, a flexible member and a sacral support member. The backrest has a frame with a generally central opening. The flexible member is connected to the frame and extends across the central opening. A sacral support member is positioned proximate the central opening and is configured to apply support to the sacrum of a user sitting on the seat and is generally visible from the front surface of the flexible member.

According to yet another aspect of the invention, a chair having sacral support is provided. The chair includes a seat, a backrest, a flexible member, a sacral support member and an adjustment member. The backrest has a frame with a generally central opening. The flexible member is connected to the frame and extends across the central opening. A sacral support member is positioned proximate the central opening and is configured to apply support to the sacrum of a user sitting on the seat. The adjustment member is capable of adjusting the position of the sacral support member.

As used herein the term "connected to" is intended to be interpreted broadly and to include direct and indirect connections.

As used herein the term "configured to apply support to the sacrum of a user" is intended to be interpreted broadly and to include direct and indirect support of the sacrum, i.e., direct support of sacrum or the control of support in the area of a user's posterior superior iliac spine (PSIS) so as to indirectly support the sacrum.

The present invention, together with attendant objects and advantages, will be best understood with reference to the detailed description below in connection with the attached drawings.

DETAILED DESCRIPTION OF THE PREFERRED EMBODIMENTS

Figure 1:
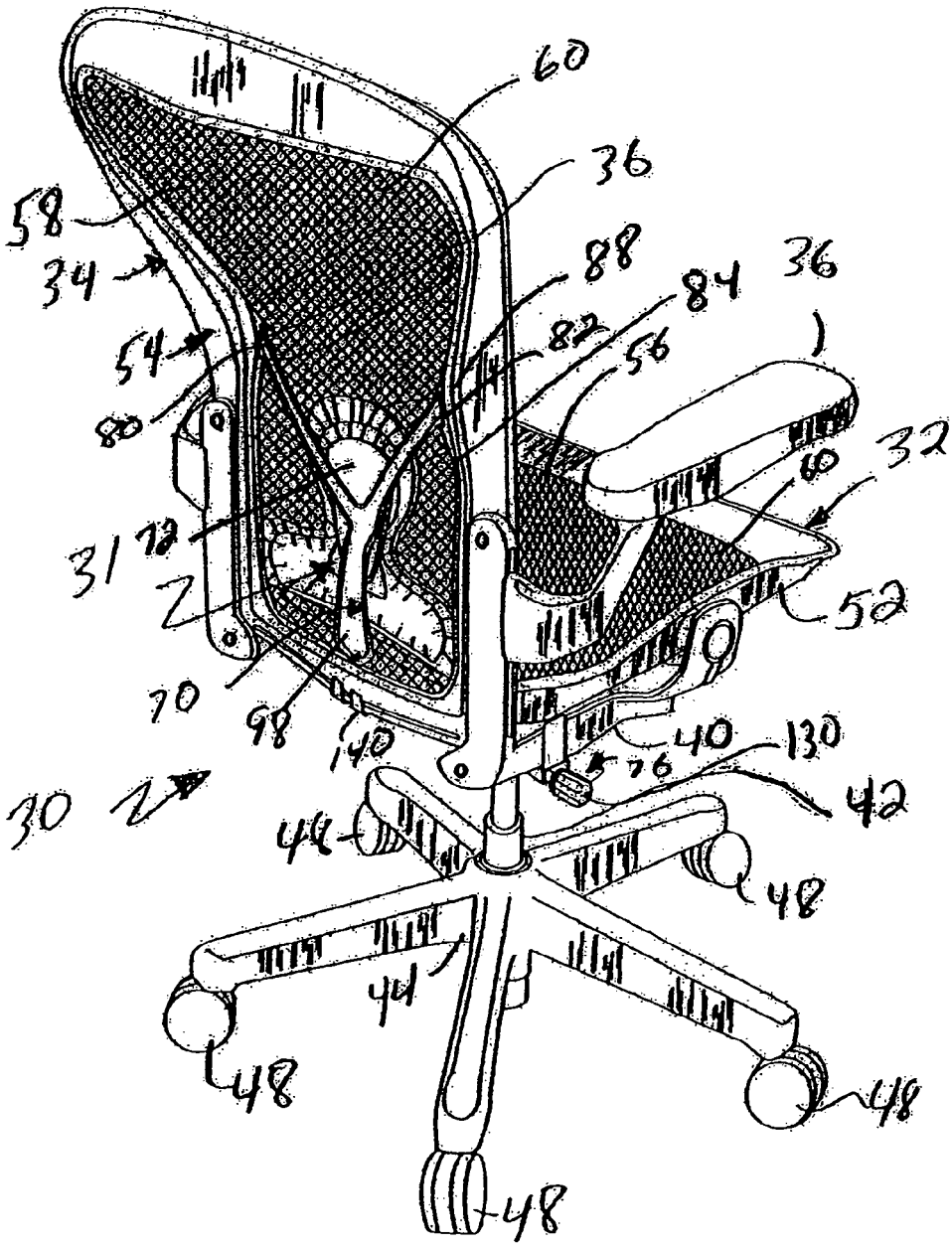
FIG. 1 is a rear perspective view of a chair having a sacral support member in accordance with a first embodiment of the present invention.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings. It should also be understood that the drawings are not to scale and in certain instances details have been omitted which are not necessary for an understanding of the present invention, such as conventional details of fabrication and assembly.

Referring to the drawings, FIGS. 1-4 show an embodiment of the present invention, and particularly, an ergonomic chair 30 having a retrofittable sacral support member 31. While the chair 30 is an office chair manufactured by Herman Miller Inc. of Zeeland, Mich., under the name AERON®, it should be recognized that the sacral support member 31 of the present invention has application in a wide variety of seating applications such as home seating, commercial seating, industrial seating, medical seating, e.g., wheelchair seating and various transportation seating elements such as motor vehicle seating, marine or aviation seating. The chair 30, shown in a neutral tilt position, includes a seat 32, a backrest 34 and pair of armrest assemblies 36. The seat 32 and backrest 34 are connected to a tilt control housing 38, best shown in FIG. 4, by a linkage assembly 40. The height-adjustable dual stage support column 42 is secured to the center of the pedestal 44. The pedestal 44 is movably supported by a base surface, such as a floor, by a plurality of castors 48 or the like. The seat 32 includes a seat frame 52 and the backrest 34 includes a backrest frame 54. The seat frame 52 includes a central opening 56 and the backrest frame 54 includes a central opening 58. A flexible material, preferably an elastomeric membrane 60, is stretched across the central openings 56, 58 in order to provide a seating surface and a backrest surface for a user. For a further description of the general construction, assembly and operation of the chair 30, reference is made to U.S. Pat. No. 6,059,368, entitled "Office Chair", filed on Jun. 7, 1995, in the name of William E. Stumpf et al., the disclosure of which is hereby incorporated by reference.

Figure 2:
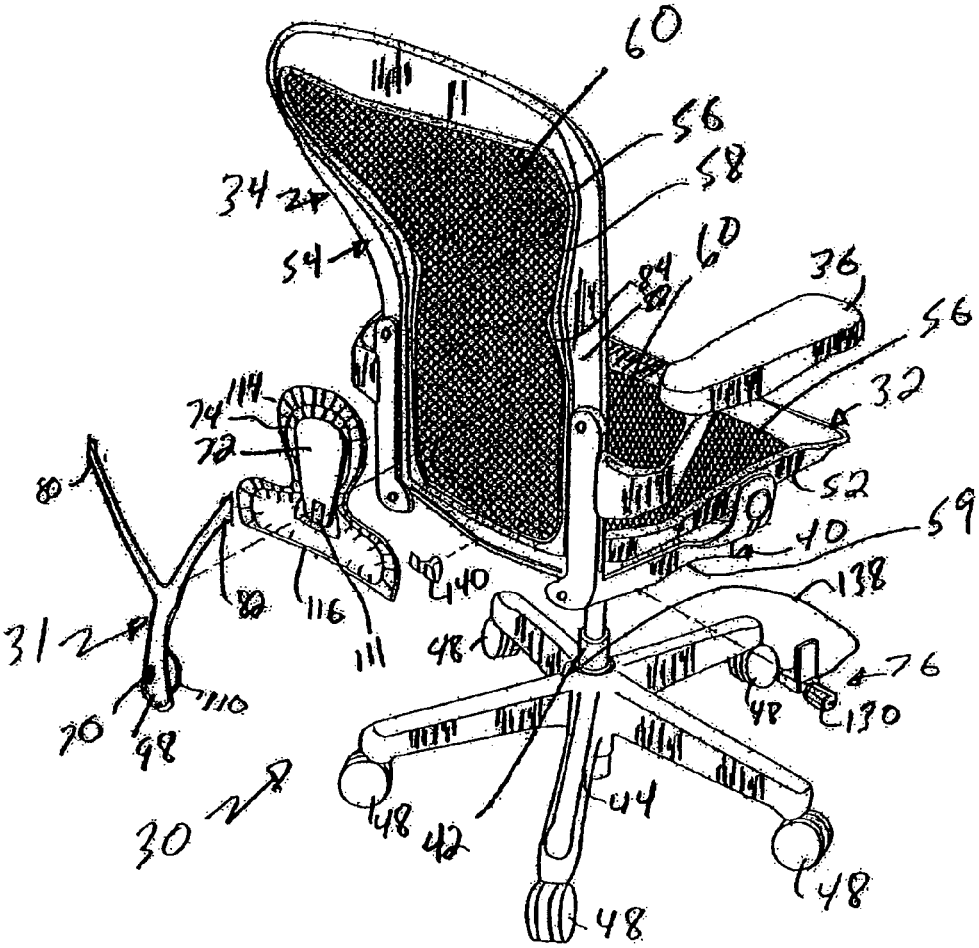
FIG. 2 is a rear perspective view of the chair of FIG. 1 with the sacral support member shown exploded from the chair.

Referring generally to FIG. 2, the embodiment of the sacral support member 31 includes a yoke 70, a support member 72, a pad 74 and an adjustment mechanism 76. Reference is made to U.S. Pat. No. 6,125,851 (Spinal Support For Seating) filed on Jul. 15, 1997, and issued on Oct. 3. 2000, in the name of Brock M. Walker, the disclosure of which is hereby incorporated by reference, for the operation and construction of a related sacral support device. The yoke 70 has a generally wishbone-like shape in the preferred embodiment. The yoke 70 includes opposing arms 80, 82 that are connected to a lip 84 that extends from a rear surface 88 of the backrest frame 54.

Figure 3:
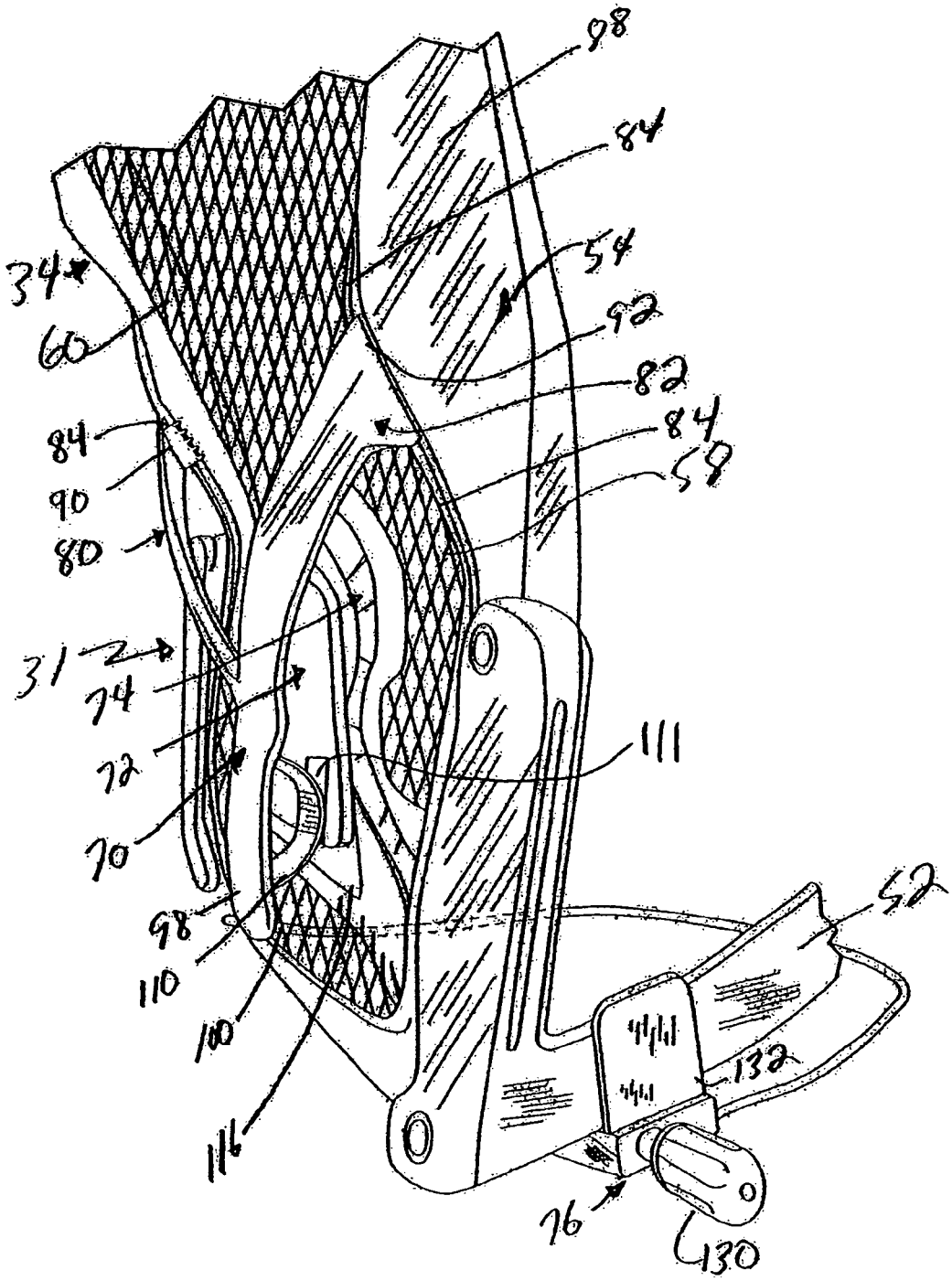
FIG. 3 is an enlarged side perspective view of the sacral support member of FIGS. 1-2 shown attached to the chair.

With particular reference to FIG. 3, the arms 80, 82 include connectors 90, 92 that have channels (not shown) sized to engage the lip 84. The base 98 of the yoke 70 is connected to the adjustment mechanism 76. In particular, the base 98 includes a cavity adapted to receive a barrel 99 (FIG. 4) connected to the movable wire 100. Preferably, the yoke 70 is formed from materials such as glass filled polypropylene or nylon.

A curved or arch-shaped surface 110 extends from the base 98 of the yoke 70. The curved surface 110 presses against the support member 72. It should be recognized that, in the preferred embodiment, the support member 72 and pad 74 are preferably not directly connected to the chair 30 except for being pressed into position against the membrane 60 by the yoke 70.

The support member 72 may include a channel 111 adapted to receive the curved surface 110. The support member 72 is preferably formed from a somewhat rigid material in order to provide support for the sacrum of a user. The support member 72 is preferably formed from known plastics materials such as polypropylene, polyethylene or ABS.

The top width of support member 72 can vary from 3 times the width of the sacrum of a user at the sacral base to a dimension approximately equal to the width of the posterior portion of the sacrum of a user still at the level of the sacral base and decreases the width progressively toward the bottom of the lower portion of the support member 72 where the width is greater than or equal to the width of the sacrum of a user at that point.

Reference is made to U.S. Pat. No. 6,125,851 for a further description of the related support block member and associated structure described therein.

An embodiment of the pad 74 is best seen in FIG. 2. The pad 74 includes a top portion 114 and a tail portion 116. In the preferred embodiment, the pad 74 is shaped to produce, relieve and/or control anatomical contact pressure where a user's PSIS contacts the chair, and to control nesting of ilia bones. The pad 74 is formed from a somewhat flexible material in order to provide a relatively firm support for the sacrum of a user while allowing adjacent soft tissue to relax by way of an improved load distribution system that provides enhanced pelvic stabilization, support, and contoured fit. The pad 74 provides and controls improved load transference from the sacral anatomy to the adjacent tissues. Materials such as plastic materials (polypropylene or polyethylene) may be used to construct the pad 74. It should also be recognized that the pad 74 may be constructed from a single material or a combination of materials to provide a variety of support or force creating effects on the sacrum of a user. In operation, the pad helps avoid the creation of any pressure points on the back of a user.

Figure 4:
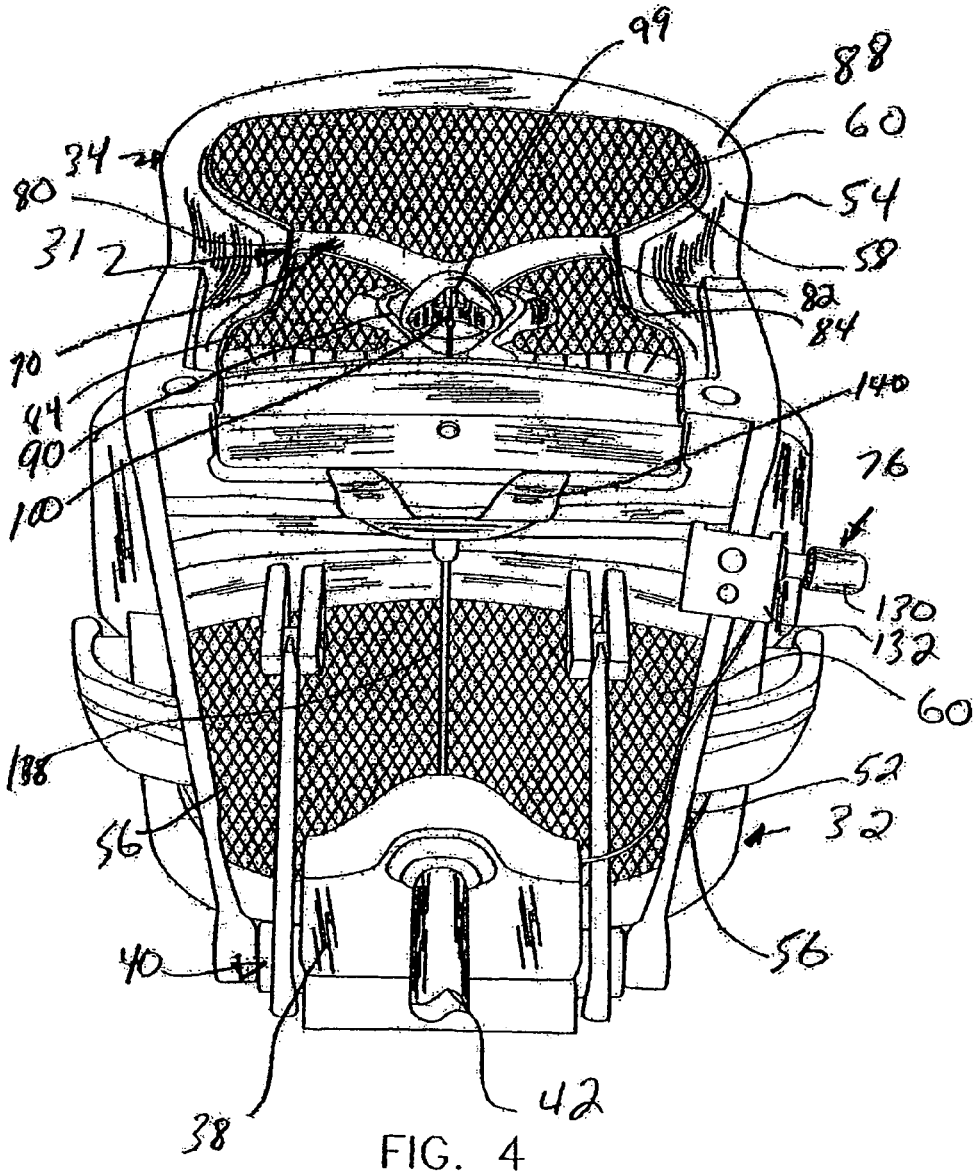
FIG. 4 is an enlarged bottom perspective view of the sacral support member of FIGS. 1-3 shown attached to the chair.

An embodiment of the adjustment member 76 is generally a conventional linear actuator as shown in the figures. An actuation element or knob 130 is connected by the bracket 132 to the linkage 40. The knob 130 includes a gear arrangement adapted to draw in or release an elongated wire 100 located in the protective housing 138. The protective housing 138 passes through the membrane 60 and is connected to base 98 of the yoke 70. A clip 140 is used to guide the wire 100 and protective housing 138 through the membrane 60, as best shown in FIGS. 3-4. The present adjustment member provides a microadjustment that allows a user to precisely select the designed position for the sacral support member 31. It should be recognized that the adjustment member 76 may include a quick release feature which immediately releases the yoke 70 and the support member 72 and the pad 74 from engagement with the membrane 60. Also, the adjustment member 76 may be designed to include height or angle adjustment as well. For example, the sacral support member 31 can direct pressure at an angle that can vary. The orienting surface which faces the user's back and the flexible material 60 will preferably maintain a desirable sacral base angle of from about 0 degrees to 50 degrees from a plane normal to a substantially horizontal seat with a user seated thereon.

In operation, a user would rotate the knob 130 in order to draw in or release the wire 100 passing within the protective housing 138. Accordingly, the base 98 of the yoke 70 is drawn toward or released from the membrane 60 and particularly, the sacrum of a user seated in the chair 30. The curved surface 110 acts to bias the yoke 70 away from the membrane 60 such that by releasing the wire 100 within the protective housing, the support member 72 and pad 74 are released from engagement with the membrane 60.

Figure 5:
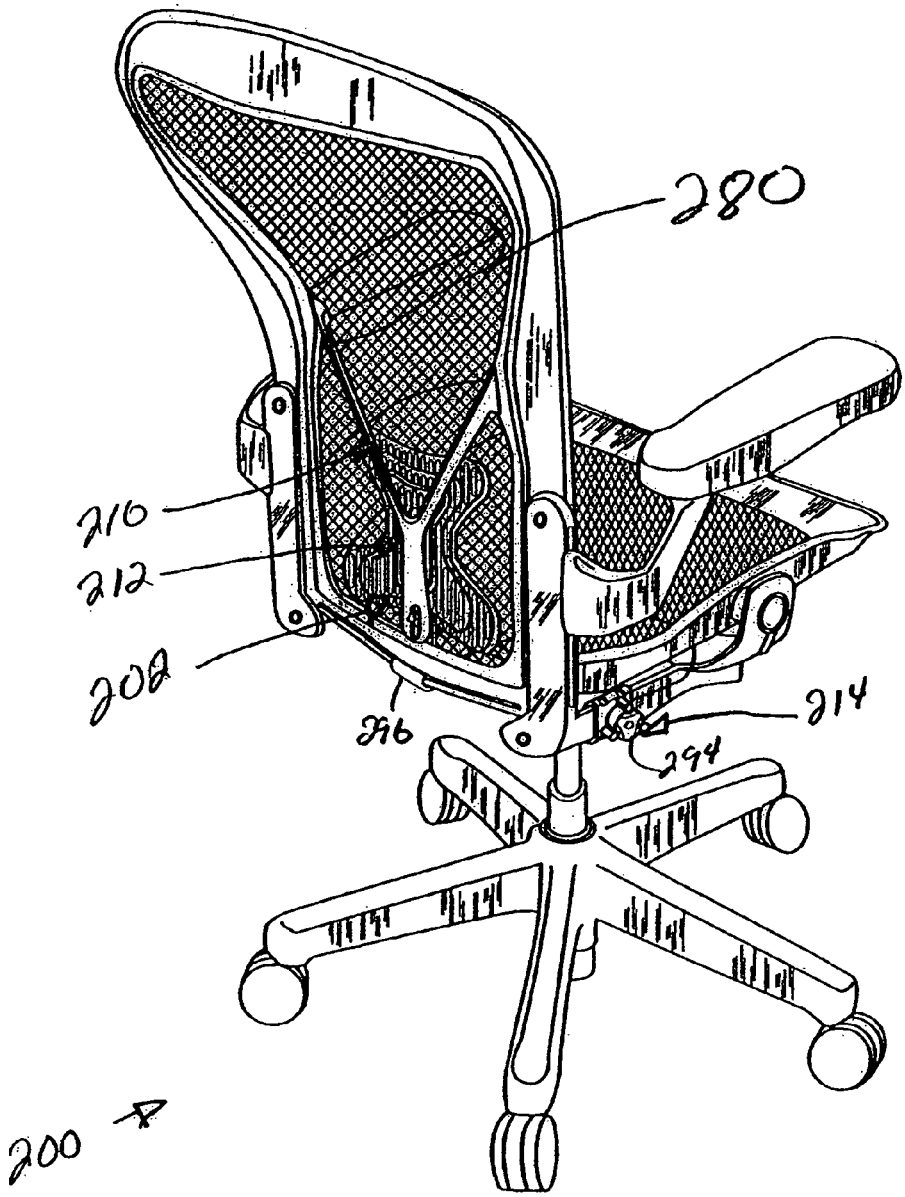
FIG. 5 is a rear perspective view of a chair having a sacral support member in accordance with a second embodiment of the present invention.
Figure 6:
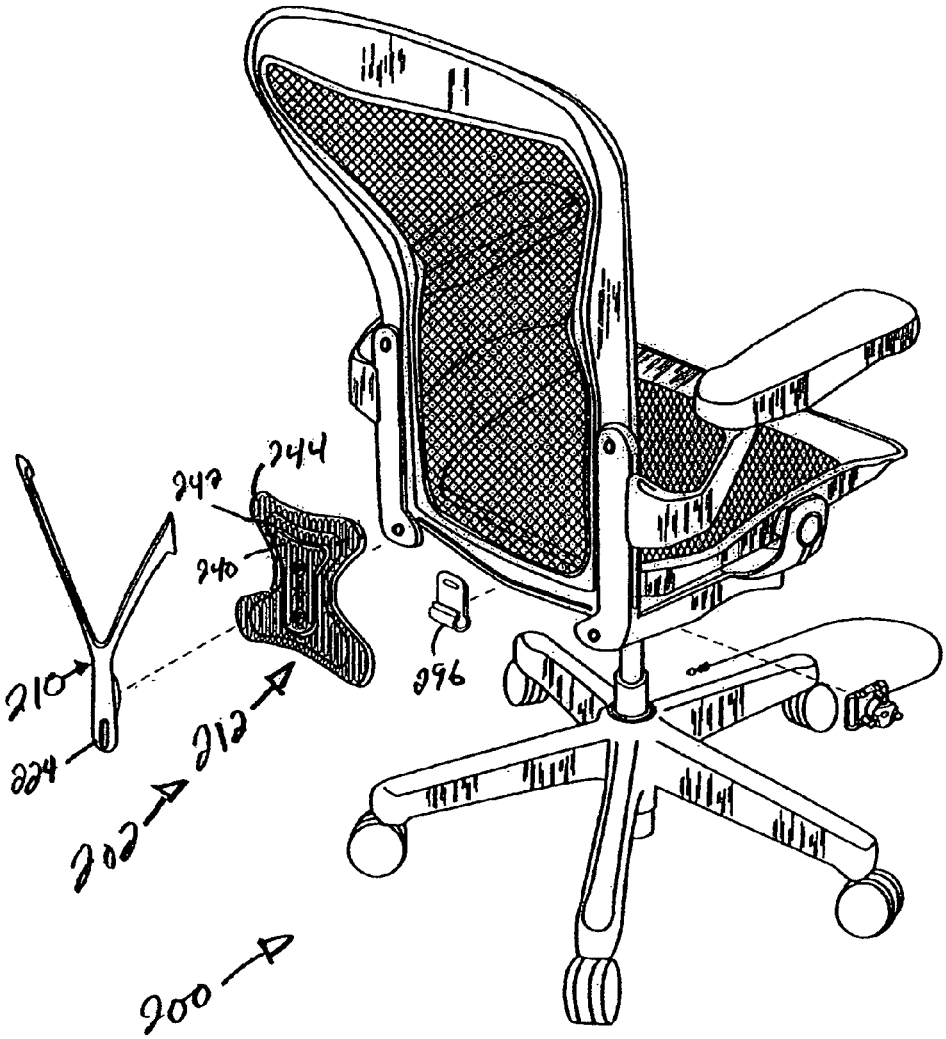
FIG. 6 is a rear perspective view of the chair of FIG. 1 with the sacral support member shown exploded from the chair.
Figure 7:
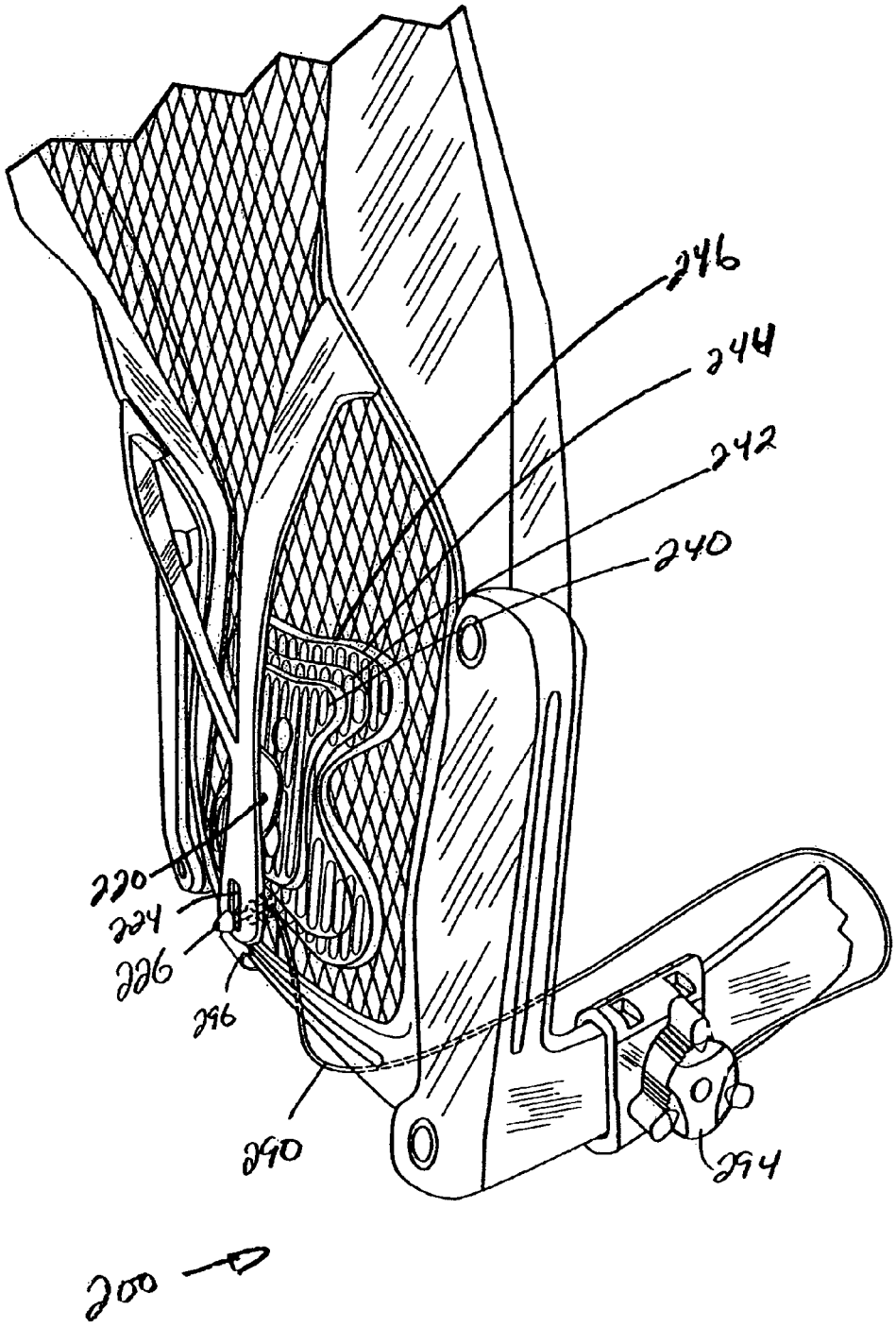
FIG. 7 is an enlarged side perspective view of the sacral support member of FIGS. 5-6 shown attached to the chair.

Another embodiment of the sacral support member is illustrated in FIGS. 5-8 on the chair 200. The sacral support member 202 operates generally in the same manner as does the embodiment of FIGS. 1-4. Referring generally to FIG. 5, the sacral support member 202 includes a yoke 210, a support member 212, and an adjustment mechanism 214. The yoke 210 has a generally wishbone-like shape and operates in the same general manner as does the embodiment 70 of FIGS. 1-4. However, the yoke 210 includes an integrally molded curved surface 220 (FIG. 7) that extends toward the support member 212. The curved surface 220 includes a cavity that is adapted to receive the notch 222 that extends from the support member 212. The yoke 210 also includes a slot 224 that is adapted to receive a portion of the control mechanism 214, i.e., the barrel 226.

Figure 8:
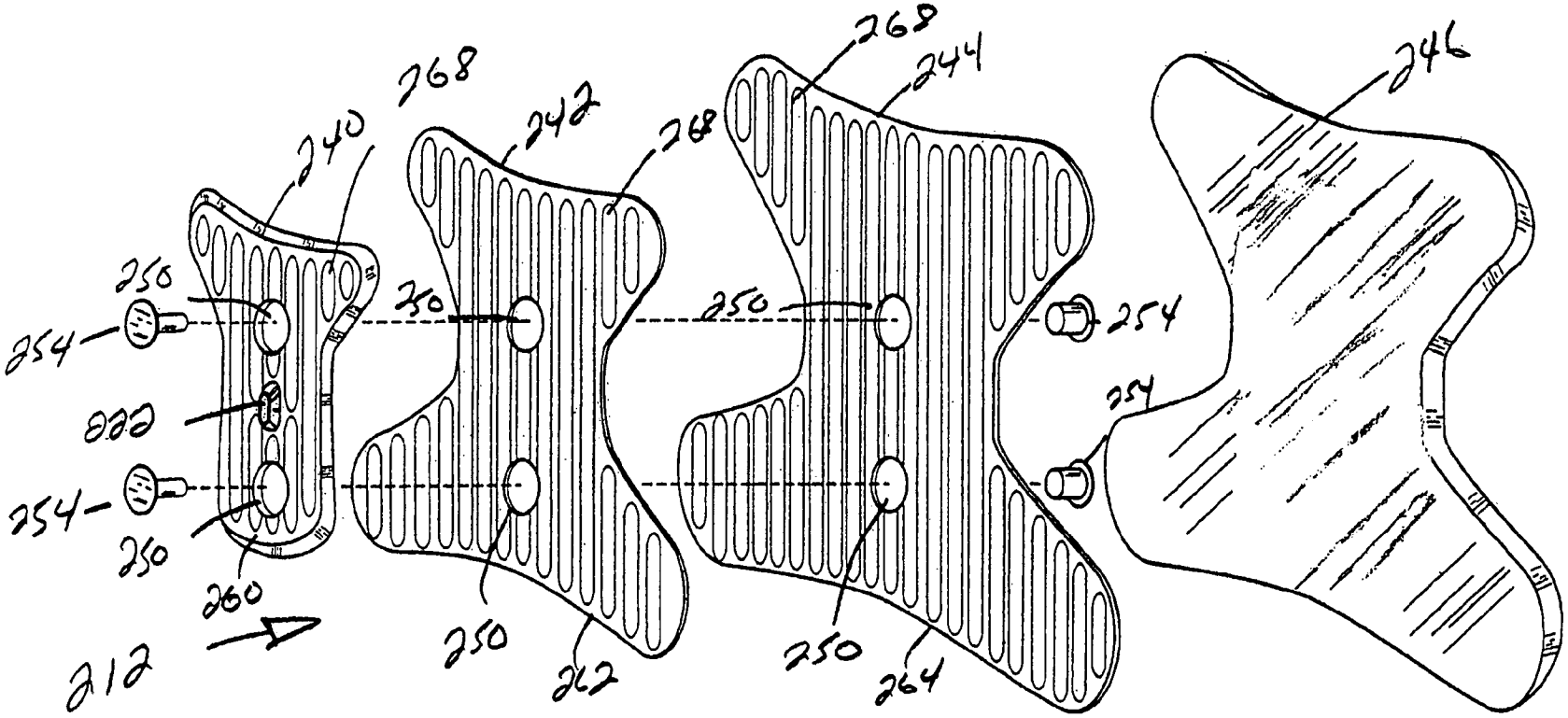
FIG. 8 is an exploded view of a portion of the sacral support member.

With particular reference to FIG. 8, the support member 212 is formed from four pieces in the illustrated embodiment. It should be recognized that the support member 212 may alternatively be formed from more than four pieces or less than four pieces. In the illustrated embodiment, the support member 212 includes a top plate 240, an intermediate plate 242, a bottom plate 244 and a pad 246. The top plate 240 is the plate that is in the posterior most position relative to the back of a user. The top plate 240 further includes the notch 222 that is connected to the yoke 210. The top plate 240 is preferably formed from a slightly thicker material in order to be slightly more rigid than the intermediate plate 242 and the bottom plate 244. The top plate 240 is the smallest plate and is not shaped, in the illustrated embodiment, in the general form of a butterfly like the intermediate plate 242 and the bottom plate 244. In a preferred embodiment, the top plate 240 is formed from injection molded ABS. Also, the top plate 240 can have a height of approximately 15 cm, a top width of approximately 10 cm, a midline width of approximately 6 cm and bottom width of approximately 6.5 cm. The top plate 240 may also have a thickness of approximately 1 cm.

Holes 250 pass through the top plate 240, the intermediate plate 242, and the bottom plate 244. The holes 250 are adapted to receive fasteners 254. The fasteners 254 secure the three plates together. It should be recognized, however, that the plates are still movable with respect to each other. The slight shear movement of the plates 242, 244 provides for the desired flexibility and load distribution. Each of the plates 240, 242, and 244 has a generally flat bottom surface and top surfaces 260, 262, 264 are formed with a plurality of groves 268. The grooves 268 are formed for aesthetic purposes. In the illustrated embodiments, the intermediate plate 242 and the bottom plate 244 each have a thickness of approximately 0.06" in order to provide for a relatively flexible surface. Also, the butterfly shape of the intermediate plate 242, the bottom plate 244 and the pad 246 is intended to provided a custom support, fit and load distribution to the three dimensional contours of user's pelvic anatomy by 1) controlling the nesting of the PSIS, 2) controlling, e.g., relieving pressure on the protruding bony structures, and 3) controlling, e.g., relieving the contract pressure on adjacent anatomical tissues.

The bottom plate 244 is attached to the pad 246. The pad 246 is preferably formed from a somewhat flexible material such as open cell urethane foam. The sacrum support member 202 including the plates 240-244 and the pad 246 combine to provide a relatively firm support for the sacrum while stabilizing and relaxing adjacent soft tissues by providing properly controlled contact pressure and a contoured fit for the sacrum and ilia. The sacral support member 212 provides an improved load transference method and system for the sacrum and adjacent tissues and improves comfort for the user. In the illustrated embodiment, the pad 246 has a thickness of approximately 10 mm. As illustrated in the figures, the pad 246 serves as an interface with the membrane 280.

The control mechanism 214 is a conventional device that pulls the cable 290 and the barrel 226 toward or away from the back of a user as generally described previously herein. A knob 294 is used to control the movement of the cable 290. Clip 296 is used to assist in control of the cable 290 and particularly as it passes through the membrane 280. It should also be recognized that the sacral support member of the present invention could be implemented as a static or nonadjustable support.

The sacral support member 202 regulates and manages the customization of force, support, angle, pelvic tilt and contoured fit across the entire pelvis of a user. The sacral support member 202 controls load distribution to the user's pelvic anatomy, and provides nesting for the PSIS landmarks through control of the surface compression ratio. Also, the sacral support member 202 provides for the PSIS landmark location zone in the proximity of 135 mm to 150 mm above the ischial turburosities of a user, and approximately 35 mm each side of the centerline of the sacrum. Lastly, the present invention provides control of the independent anatomical dynamics between the sacrum and the ilia, thereby achieving adjunctive control of associated articular structures. It should be appreciated that the present invention is effective for both static and dynamic user activity in a variety of postural positions, ranging from aggressive task to fully recumbent.

The embodiments described above and shown herein are illustrative and not restrictive. The scope of the invention is indicated by the claims rather than by the foregoing description and attached drawings. The invention may be embodied in other specific forms without departing from the spirit of the invention. For example, other adjustment mechanisms may be used with the present invention. In addition, the shape and construction of the pad and associated structure could be varied while still achieving the required functionality e.g., the sacral support member of the present invention could be located in front of the associated back rest and attached to the seat pan. Accordingly, these and any other changes which come within the scope of the claims are intended to be embraced herein.

We claim:

1. A chair providing sacral support, comprising:

a seat having a seat frame;

a backrest having a backrest frame with a generally central opening, the backrest frame having a front portion and a rear portion;

a single flexible member connected to the backrest frame and extending across the central opening, the flexible member having a front surface and rear surface;

a sacral support member connected to the backrest and positioned proximate the central opening and behind the flexible member, the sacral support including a first central support and a second outer support and the first support being configured to apply support through the flexible member to the sacrum of a user sitting on the seat and the second support connected to and extending laterally from the first support and being configured to apply a second distinct support to areas adjacent to the sacrum of the user, wherein the sacral support member is located behind the front surface of the flexible member;

an adjustment member connected to the seat frame, the adjustment member configured to adjust the position of the sacral support member;

an actuation portion of the adjustment member is connected to a support structure for the seat frame; and wherein the adjustment member includes an elongated portion that extends through the flexible member to the actuation portion.

2. The chair of claim 1 wherein the elongated portion is connected to a yoke, the yoke is connected to the backrest frame so as to abut against the sacral support member.

3. The chair of claim 2 wherein the yoke includes a cavity adapted to receive an end of the elongated member.

4. A chair for providing sacral support, comprising:

a seat having a seat frame;

a backrest having a backrest frame with a generally central opening, the frame having a front portion and a rear portion;

a single flexible member connected to the backrest frame and extending across the central opening, the flexible member having a front surface and rear surface;

a sacral support member connected to the backrest positioned proximate the central opening and including a direct and central support and an indirect and outer support, wherein the direct support is configured to apply support through the flexible member to the sacrum of a user sitting on the seat and the indirect support connects to and extends laterally from the first support and is configured to allow an area adjacent to the sacrum to be relaxed; and an adjustment member operably connected between the sacral support member and the seat, and is capable of adjusting the position of the sacral support member;

wherein an actuation portion of the adjustment member is connected to a support structure for the seat frame; and wherein the adjustment member includes an elongated portion that extends through the flexible member to the actuation portion.

5. The chair of claim 4 wherein the elongated portion is connected to a yoke, the yoke is connected to the backrest frame so as to abut against the sacral support member.

6. A chair for providing sacral support, comprising:

a seat having a seat frame;

a backrest having a backrest frame with a generally central opening, the frame having a front portion and a rear portion;

a flexible member connected to the backrest frame and extending across the central opening, the flexible member having a front surface and rear surface; and a sacral support member positioned proximate the central opening and being configured to apply support through the flexible member to the sacrum of a user sitting on the seat, the sacral support member including a yoke, a support member and a pad, such that the yoke is coupled with the backrest frame, the support member is coupled with the yoke, and the pad is coupled with the support member, the yoke being moveable relative to the support member and the pad by way of an adjustment member as a curved surface on the yoke presses against the support member.

7. The chair of claim 6 wherein the movement is a pivoting action.

8. The chair of claim 6 wherein the yoke includes an outwardly extending curved surface that engages the support member.

9. The chair of claim 8 wherein the support member includes a channel adapted to receive the curved surface.

* * * * *